US005641084A

United States Patent [19]

Rice

[11] Patent Number: 5,641,084

[45] Date of Patent: Jun. 24, 1997

[54] TAMPER EVIDENT SHRINK BAND

[75] Inventor: Michael J. Rice, St. Paul, Minn.

[73] Assignee: The Pillsbury Company, Minneapolis, Minn.

[21] Appl. No.: 578,375

[22] Filed: Dec. 26, 1995

Related U.S. Application Data

[63] Continuation of Ser. No. 277,953, Jul. 20, 1994, abandoned.

[51] Int. Cl.[6] ..... B65D 41/54

[52] U.S. Cl. ..... 215/246; 220/214; 156/86; 156/69; 53/442; 53/463; 428/916; 428/34.9; 428/347

[58] Field of Search ..... 215/246, 273, 215/230, 232, 254, 901; 220/214, 359; 206/497, 459.1; 156/86, 69; 53/419, 441, 442, 463, 478, 137.2, 176; 428/34.9, 347, 343, 200, 202, 203, 916

[56] References Cited

U.S. PATENT DOCUMENTS

| | | | |
|---|---|---|---|
| 3,243,211 | 3/1966 | Wetmore | 156/86 X |
| 3,382,121 | 5/1968 | Sherlock | 156/86 X |
| 3,923,198 | 12/1975 | Brochman | 220/359 |
| 3,935,960 | 2/1976 | Cornell | 220/260 |
| 4,009,793 | 3/1977 | Minesinger et al. | 215/246 |
| 4,557,505 | 12/1985 | Schaefer et al. | 283/81 |
| 4,579,240 | 4/1986 | Ou-Yang | 215/232 X |
| 4,652,473 | 3/1987 | Han | 428/35 |
| 4,718,553 | 1/1988 | Adamoli et al. | 206/459 |
| 4,721,217 | 1/1988 | Phillips et al. | 215/230 |
| 4,782,976 | 11/1988 | Kenyon, 2nd. | 220/306 |
| 4,813,559 | 3/1989 | Kenyon, 2nd. | 215/230 |
| 4,865,198 | 9/1989 | Butler | 206/459 |
| 4,960,216 | 10/1990 | Giles et al. | 215/232 |
| 4,972,953 | 11/1990 | Friedman et al. | 215/365 X |
| 5,111,953 | 5/1992 | Faust et al. | 220/214 |
| 5,197,618 | 3/1993 | Goth | 215/232 |
| 5,217,307 | 6/1993 | McClintock | 215/246 X |
| 5,265,745 | 11/1993 | Pereyra et al. | 215/232 |
| 5,294,470 | 3/1994 | Ewan | 428/40 |
| 5,314,749 | 5/1994 | Shah | 206/497 X |
| 5,470,622 | 11/1995 | Rinde et al. | 156/86 X |

FOREIGN PATENT DOCUMENTS

| | | | |
|---|---|---|---|
| WO9319445 | 3/1992 | WIPO | G09F 3/02 |

OTHER PUBLICATIONS

Hanlon; Handbook of Package Engineering; 1971; pp. 3–5 to 3–9.

Bakker; The Wiley Encyclopedia of Packaging Technology; 1986; pp. 335–338.

The Wiley Encyclopedia of Packaging Technology, Marilyn Bakker, Editor–in–chief / 1986.

Handbook of Package Engineering, By Joseph F. Hanlon / 1971.

*Primary Examiner*—Allan N. Shoap
*Assistant Examiner*—Nathan Newhouse
*Attorney, Agent, or Firm*—Janal M. Kalis; Aleya Rahman

[57] ABSTRACT

The present invention is a tamper evident container sealing system for sealing a cap to a container. The system includes a shrink band, shrinkable at a shrink temperature, positioned about the cap and container circumferentially, a colorant bonded to the shrink band and an adhesive bonded to the colorant. The adhesive is thermally activatable at the shrink temperature. The adhesive is in contact with the container.

9 Claims, 3 Drawing Sheets

TAMPER EVIDENT SHRINK BAND

This is a continuation of prior application Ser. No. 08/277,953, filed Jul. 20, 1994, now abandoned.

BACKGROUND OF THE INVENTION

The present invention relates to a tamper evident shrink band for use in sealing a cap to a container.

Packaging articles such as foods and drugs requires a consideration of traditional concerns related to preventing passive contamination by bacteria and other contaminants from the environment. Packaging of the articles, unfortunately, also requires a consideration of preventing active contamination caused by human tampering of articles to be ingested.

A package designer must then consider not only how to contain and seal an article that is ingested but must also consider how to signal to a user that tampering has occurred. The signal itself must deter tampering. Satisfying these two criteria has frequently involved designing two separate mechanisms. A first mechanism addresses only a sealing function of the packaging. A second mechanism addresses only the tamper signal function.

This two mechanism approach to packaging has provided an intermediate solution to sealing and package security. However, the approach has produced inefficient packaging because an excessive quantity of materials has been required to make the two mechanisms. Additionally, this approach to packaging has frequently been inconvenient to the end user because the user must separately figure out how to breach each of the sealing mechanism and the tamper proof mechanism.

The Ewan patent, U.S. Pat. No. 5,294,470, issued Mar. 15, 1994, describes a tamper proof sealing container and a seal. The Ewan patent describes a band having an inner surface with a masking material disposed in an indicia-defining pattern on the inner surface. The masking material adheres to the inner surface of the band. A colorant layer overlays the masking material. An adhesive is applied over the colorant layer.

The Ewan patent further includes a container holding articles having a surface and a flap. The flap has a window that registers with the surface of the container when the flap is closed.

The inner surface of the band has a relatively greater adhesion to the colorant layer than the masking layer. When the inner surface of the band applied to a container is lifted away from a container surface, the unmasked colorant layer is removed with the inner surface of the band leaving the masking material and colorant layer beneath the masking material on the container holding the articles. The inner surface of the band, lacking adhesive, then prevents the seal from being replaced in its original condition. Consequently, the seal irreversibly indicates when it is opened.

The Butler patent, U.S. Pat. No. 4,865,198, issued Sep. 12, 1989, describes a method for imprinting an image on an interior surface of an overcap film by vaporizing ink from an underlying inner surface. An activating energy source such as a pulsed laser beam is used to imprint words or symbols on the film by vaporizing ink or pigment from the underlying substrate. The vaporized ink transfers in register to an inside surface of the overcap. Unless one of the film and overcap surfaces is moved with respect to the other, no tamper-evident indicia appear to be present in the overcap package structure.

The Kenyon 2nd patent, U.S. Pat. No. 4,782,976, issued Nov. 8, 1988, describes a tamper evident plastic canister, with plastic snap-on reclosure lid and shrink band assembly. The canister includes a canister body and a rim. The rim enables reclosure of the canister with the snap-on lid. The shrink band engages a sidewall of each of the lid and canister. The shrink band is positioned about the lid and canister and then shrunk into place. The shrink band is scored in a manner that reveals attempts to remove the shrink band from the canister and lid. The tampering attempts become identifiable in the form of visible fractures or tears in the shrink band.

The Kenyon 2nd patent, U.S. Pat. No. 4,813,559, issued Mar. 21, 1989, describes a tamper-evident closure that includes a shrink band for a container with a rim and a lid secured to the container around the rim. The tamper-evident closure includes a label bonded to each of the container and the shrink band. The label includes a weakened line such as a line of perforations encircling the label just below the lower edge of the shrink band. Additional adhesive below this perforated line will bond the remainder of the label to the body of the container. When the shrink band is torn away from the container, the shrink band carries with it the upper portion of the label.

The Faust et al. patent, U.S. Pat. No. 5,111,953, issued May 12, 1992, describes a lid assembly. The lid assembly includes a lid having a lower rim and a seal strip that is irreversibly attached to the lower rim. The seal strip includes a first heat shrinkable section. The seal strip extends circumferentially around the rim. The seal strip also includes a strip of pressure-sensitive adhesive tape and a second heat shrinkable section.

SUMMARY OF THE INVENTION

The present invention includes a tamper evident container seal for sealing a cap to a container. The seal includes a shrink band, shrinkable at a shrink temperature, that is positioned securely about the cap and container circumferentially. A colorant layer is bonded to the shrink band. A thermally activatable adhesive layer is bonded to the colorant layer. The adhesive layer is activatable at the shrink temperature.

The present invention also includes a tamper evident container sealing system that includes the shrink band positioned circumferentially about the cap and container and in addition includes a first colorant coating bonded to the shrink band. An adhesive coating is bonded to the first coating. An ink coating is bonded to the adhesive. A release coating defining indicia is masked by the ink coating when the container is sealed. The indicia are revealed to a user when the sealing system is breached by application of a peel force.

The present invention also includes a method for making a tamper evident seal on a container having an overcap. The method includes applying a heat shrinkable strip, shrinkable at a shrink temperature, to the overcap and container circumferentially. The heat shrinkable strip includes a colorant and an adhesive bonded to the colorant. The adhesive is activatable at the shrink temperature. The adhesive contacts the container. Once applied, the heat shrinkable strip, overcap and container are heated at a temperature effective to shrink the heat shrinkable strip and to bond the adhesive to the container.

DETAILED DESCRIPTION OF THE DRAWINGS

DETAILED DESCRIPTION OF PREFERRED EMBODIMENTS

Figure 1:
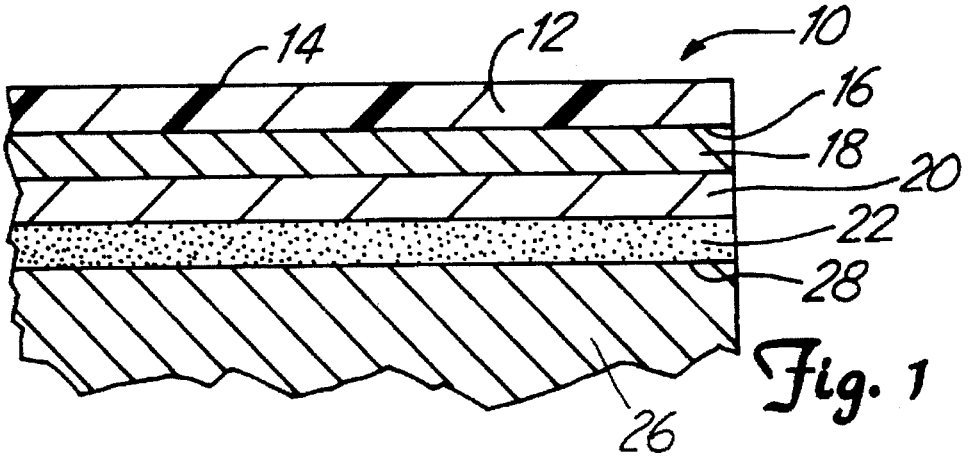
FIG. 1 is a cross-sectional view of one embodiment of the tamper evident seal of the present invention.

The tamper evident seal of the present invention illustrated in cross section generally at 10 in FIG. 1, includes a heat-shrinkable band 12, shrinkable at a shrink temperature, having an outer surface 14 and an inner surface 16. A first colorant coating 18 is bonded to the inner surface 16 of the heat shrinkable band 12. A second colorant coating 20 is bonded to the first colorant coating 18. An adhesive layer 22, activatable at the shrink temperature is bonded to the second colorant coating 20. By "activatable" is meant that the adhesive layer is capable of liquefying or melting at a specified temperature.

Figure 5:
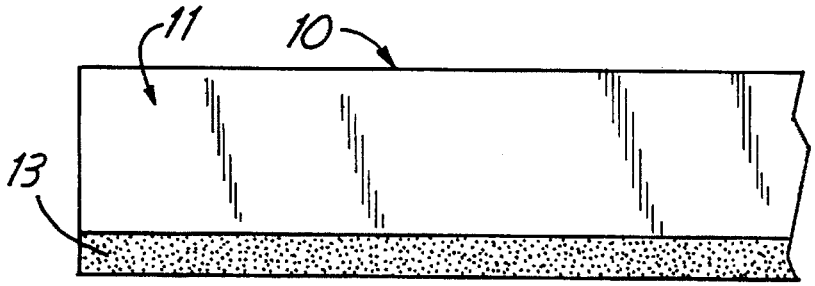
FIG. 5 is an elevational view of one embodiment of the tamper evident seal of the present invention.

The tamper evident seal 10 includes a first PVC section 11 and a second tamper evident section 13 as illustrated in an elevational view in FIG. 5. The adhesive layer 22 and at least one colorant coating are positioned on the second tamper evident section 13 of the seal 10. At least one of the colorant coatings is also positioned on the first PVC section 11.

Figure 2:
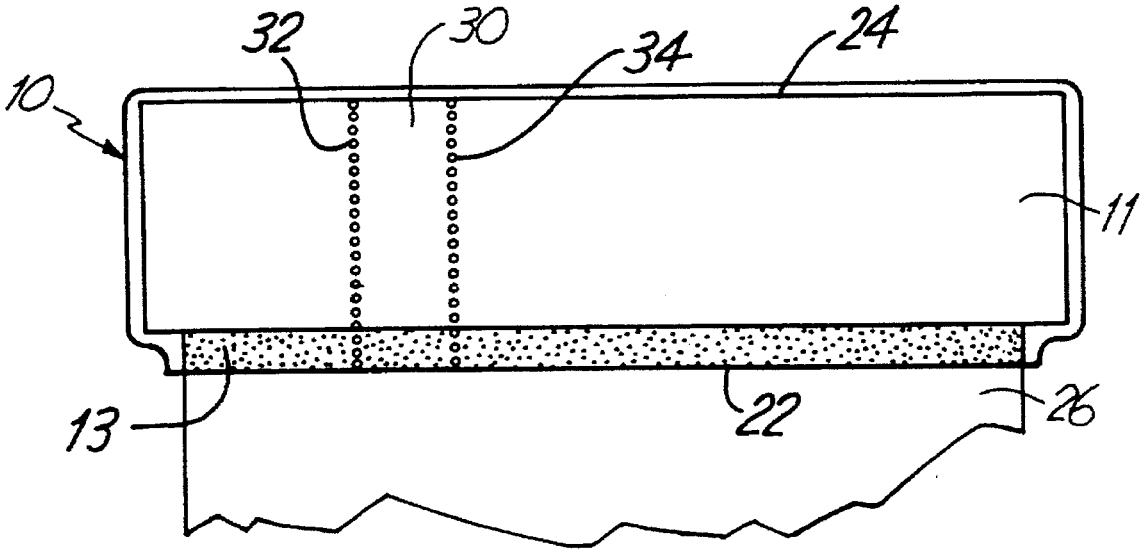
FIG. 2 is a side view of one embodiment of the tamper evident seal in a closed position positioned on a container and cap.

The tamper evident seal 10 is applied to an overcap 24 such as is illustrated in FIG. 2, and rests upon a canister 26 so that the first PVC section 11 of the seal 10 mechanically holds and seals the overcap 24 to the canister 26 and so that the second tamper evident section 13 of the seal 10 is bonded to the canister 26 by activation of the adhesive layer 22.

Because the adhesive layer 22 is thermally activatable at substantially the same temperature that the heat shrinkable band 12 shrinks, the seal 10 forms a mechanical shrink wrap seal and an adhesive seal substantially simultaneously. As a consequence, steps of shrinking the shrinkable band 12 and activating the adhesive layer 22 occur under substantially the same conditions, in one process step. This process step is completed in a single piece of process equipment, thereby improving efficiency of the process of sealing a container mechanically and for security.

With the tamper evident seal 10 of the present invention, functions of sealing an overcap 24 to a canister 26 and tamper proofing the sealed canister 26 are provided by a single narrow band of coated heat shrinkable material. This band is an improvement over previous sealing devices which required substantially more material to cover not only the overcap 24 but virtually the entire canister 26. Further, in previous devices, the function of sealing the overcap 24 to the canister 26 was separate from a tamper resistant function. Additional material and a separate mechanism had to be provided in order to make the seal and container tamper proof. One other advantage of the present invention is that by combining the functions of tamper proofing and sealing in a single narrow band 10, the present invention promotes an ease of use not found in existing sealing and tamper proof devices.

One other benefit of the tamper evident seal 10 of the present invention is that the seal 10 provides two separate signals that tampering has occurred. A first signal is that the adhesive bond has been irreversibly breached. A second signal is provided by the second colorant coating revealed by breaching the seal. The second colorant coating may display indicia providing a message that expressly states that the container has been opened.

The heat shrinkable band 12 is most preferably made from polyvinyl chloride ("PVC") that undergoes a 50% shrinkage in a cross machine direction when heated. One acceptable polyvinyl chloride is obtained by American Fuji Seal of Fairfield, N.J.. Other suitable materials include but are not limited to polyethylene, polypropylene, ethylene/vinyl acetate copolymers and ethylene/propylene copolymers. The heat shrinkable band 12 is thin, having a thickness typically less than about 2.0 mils. The heat shrinkable band 12 may be either amorphous or crystalline. Preferably, the heat shrinkable band 12 is colored or translucent. However, a transparent or colorless heat shrinkable band may be suitable for some selected embodiments.

The PVC heat shrinkable band is tenter framed in the cross machine direction prior to shrinking. Shrinkage in the cross machine direction is typically less than 50% and in the machine direction is typically less than 4%. Thus, the heat shrinkable PVC band 12 for use in the present invention having an initial circumference of about 7.8 inches is shrinkable to a circumference of about 7.1 inches. In one embodiment, the PVC band 12 has a length of 1.00 to 1.25 inches when shrunk.

The first colorant coating 18 contacting the inner surface 16 of the heat shrinkable PVC band 12 may be a red colorant. The colorant is preferably solvent-based with a high interstitial strength. The first colorant 18 is bondable to the polyvinyl chloride of the heat shrinkable band 12. In one embodiment, the first colorant coating 18, a red ink coating is applied to the PVC at a rate of about 1.6 pounds per 3,000 square feet or less by a roto gravure method known in the art.

The second colorant coating 20, in one embodiment, includes particles of aluminum dispersed in a matrix of an organic material such as nitrocellulose. The organic material may also include other additives for viscosity adjustment such as methyl acetate.

A high concentration of aluminum particles in the second colorant coating 20 is desirable because the high particle concentration aids in a separation of the second colorant layer 20 into two fractions when the tamper evident seal 10 is breached by application of a peel force.

Figure 8:
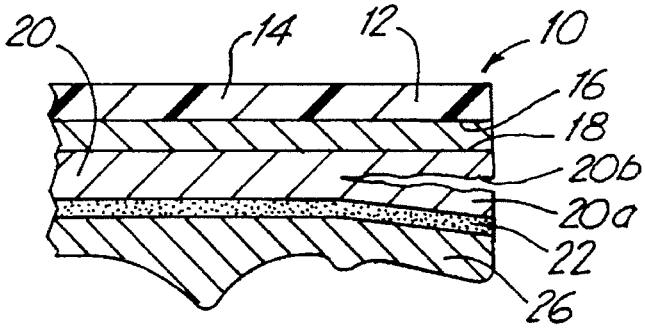
FIG. 8 is a cross sectional view of one other embodiment of the tamper evident seal in a partially open position.

It is believed that aluminum particles of the second colorant coating 20 oxidize when exposed to the atmosphere during manufacturing forming an outer oxide layer on each particle. When the tamper evident seal 10 is breached by separating the first colorant layer 18 and PVC layer 12 from the adhesive 22 and canister 26, a fraction of the layer of particles 20*a*, illustrated in FIG. 8, mechanically separates with the adhesive layer 22. Another fraction of the layer of particles 20*b* is mechanically peeled away from the canister 26 and is retained by the first colorant layer 18.

The separation is believed to occur because a bond between the aluminum and aluminum oxide of each particle is of lower strength than a bond that forms between the aluminum oxide and first colorant layer 18 contacting the aluminum oxide. Consequently, when the aluminum oxide in the second colorant layer 20 is subjected to a peel stress, such as a mechanical peel, the layer 20 separates into two fractions. One fraction of the layer 20 is retained on each of the canister 26 and the PVC band 12 pulled away from the canister 26, as shown in cross section in FIG. 8.

Figure 6:
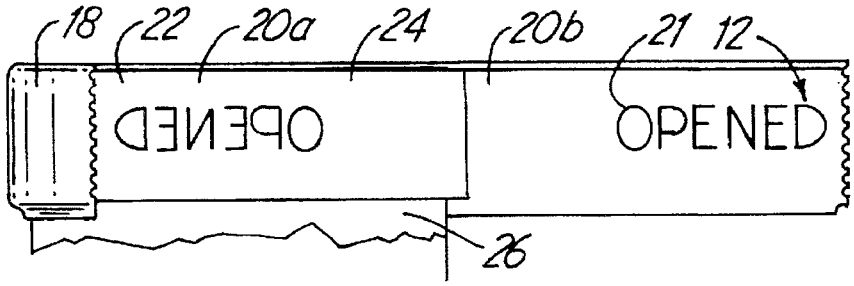
FIG. 6 is a side view of one embodiment of the tamper evident seal in an open position, positioned on the container and cap.

The second colorant coating 20 may be uniformly applied to the first colorant layer 18 or may be discretely applied to make indicia 21 on each of the second colorant layer fractions 20*a* and 20*b* as are illustrated in FIG. 6. The indicia 21 are selected to inform a user that the seal has been breached. The indicia are masked by the first colorant coating 18 when the tamper evident seal 10 is in a closed or sealed position.

In one embodiment, the adhesive layer 22 is a thermally activated layer, activated at a temperature of about 190° Fahrenheit. At the temperature of 190° F., the adhesive layer 22 liquifies and bonds to the container surface 28. It is understood, however, that any adhesive that is activatable at the shrink temperature of the shrink band is suitable for use in the present invention. The adhesive layer 22 is typically a gel lacquer made up of such materials as polyamides, polyethylene and other vinyl acetates. The adhesive layer 22 will not re-attach to the surface to which it was originally attached.

In one embodiment, the adhesive is manufactured by a Varitech Division of Pierce & Stevens of Buffalo, N.Y. The adhesive is designated as Experimental J9712AE. The adhesive has a viscosity of 180 centipoise at 112° F. The adhesive has a weight of 7.10 lbs. per gallon and a nonvolatile component of 46.7% by weight.

Because the adhesive layer 22 is typically a gel at room temperature, the adhesive is typically preheated to between 105° to 125° F. prior to application. The adhesive is typically applied to the PVC band 12 by a gravure method. The adhesive may be applied in conjunction with a thinner of ethyl acetate and naphtha in a ratio of 1:1 by volume. The adhesive is applied to the PVC band at about 2.6 to about 3.5 lbs. per 3,000 square feet. An application of about 3.5 lbs. per 3,000 square feet is preferred.

In operation, the tamper evident seal 10 is applied to the overcap 24 that rests upon the canister 26 as is illustrated in FIG. 2. The overcap 24 may be nongripping. The overcap 24 may be positioned on the canister 26 by a friction fit, interference fit or other conventional fit. In one embodiment, the overcap is made of polypropylene.

The canister 26 may be made of paper or paperboard and is preferably of a cylindrical shape. The canister 26 may also include a paper layer such as a label cylindrically attached to its surface. Most preferably, an outer surface 28 of the canister 26 contacting the tamper evident seal 10 is free of varnish.

The tamper evident seal 10 circumferentially contacts each of the overcap 24 and canister 26. The seal 10 is then initially preshrunk in order to hold position on the canister 26 and overcap 24. Next, the seal 10 is fully heat shrunk in a heat shrink chamber for about 5–8 seconds. In the heat shrink chamber, the adhesive layer 22 is thermally activated and irreversibly bonds with the outer surface 28 of the canister 26. The PVC band 12 of the seal 10 shrinks above the overcap 24 forming a mechanical seal. The formation of the mechanical seal and adhesive seal occurs substantially simultaneously.

To open the tamper proof seal 10, a user may break the seal 10 between the two fractions 20A and 20B of second colorant coating 20, bonded to each of the adhesive layer 22 and first colorant coating 18, by pulling a tab 30 as shown in FIG. 2.

Pulling the tab 30 forms a first end 32 and a second end 34 of the band 10. A user may then pull the band 10 away from the canister 26 circumferentially thereby separating the PVC layer 12 and first colorant layer 18 of the band 10 from the canister 26 as shown in FIG. 6. In separating the band 10 from the canister 26, the second colorant coating 20 is pulled apart to form the two fractions 20*a* and 20*b*. When the second colorant coating 20 is a discrete coating of particles defining indicia 21, the indicia 21 are separated between the PVC layer 12 of the tamper evident seal 10 and the first adhesive layer 22 on the canister 26 to reveal a tamper signal such as "OPENED", as shown in FIG. 6.

Figure 3:
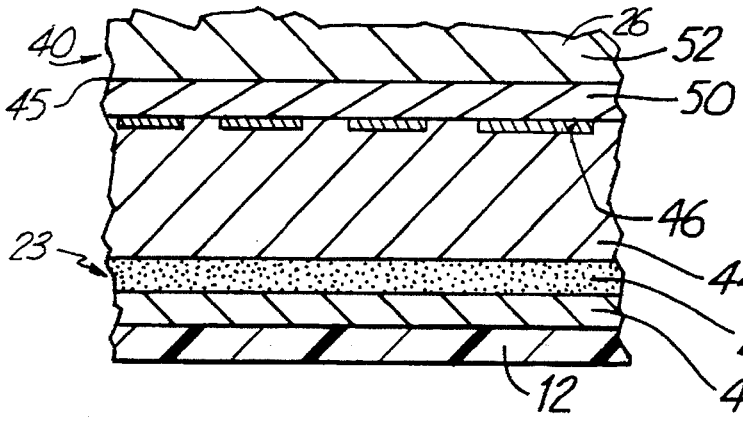
FIG. 3 is a cross-sectional view of one other embodiment of the tamper evident seal of the present invention.

One other embodiment of the present invention is illustrated as a system at 40 in FIG. 3. This embodiment, illustrated in a sealed state, includes a sealing component 23 and a label component 45 in contact with the sealing component 23. The sealing component 23 includes a first coating 42 bonded to the PVC heat shrinkable band 12. The first coating 42 may be either a colorant such as an ink coating or a clear coating. The adhesive layer 22 is applied to the first coating 42 and bonds to the first coating 42.

A background ink layer 44 overlays the adhesive layer 22. The background ink layer 44 bonds tightly to the adhesive layer 22. The background ink layer is formed on the label component 45 secured to the canister 26. The background ink layer 44 may be a conventional alkyd based ink system.

The background ink layer 44 is in contact with a release coating 46, also formed on the label component 45. The release coating 46 is applied in a pattern to form indicia. In one embodiment, the release coating 46 includes conventional ultra violet cured inks or silicon emulsifiers.

The release coating 46 rests upon and is bonded to a copy ink layer 50. The copy ink layer 50 is most preferably varnish-free and is also an alkyd-based ink. The copy ink layer 50 is bonded to a paper surface 52 of the canister 26.

In this embodiment, when a peel force is applied to the sealing component 23, separation is made at the release coating 46 so that indicia are displayed on the label component 45 on the canister 26. The background ink layer is pulled away from the release coating 46.

Figure 9:
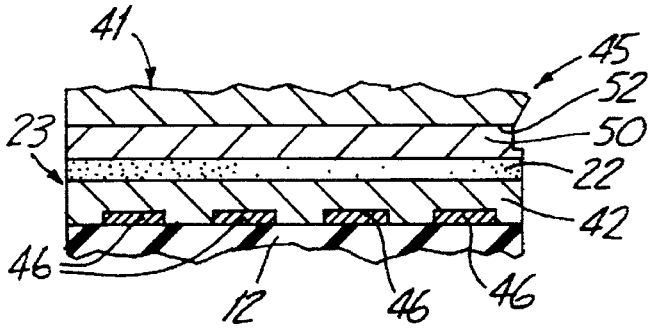
FIG. 9 is a cross sectional view of one other embodiment of the tamper evident seal in a closed position.

In another embodiment illustrated at 41 in a closed position in FIG. 9, the release coating 46 is applied to the PVC layer 12 in a pattern forming indicia. The indicia are not visible when the sealing component 23 is in a closed position. The first coating 42 overlays the release coating 46. The adhesive layer 22 overlays the first coating 42. The adhesive layer 22 is bonded to the copy ink layer 50. The copy ink layer 50 is bonded to a paper surface 52 of the canister 26.

Figure 7:
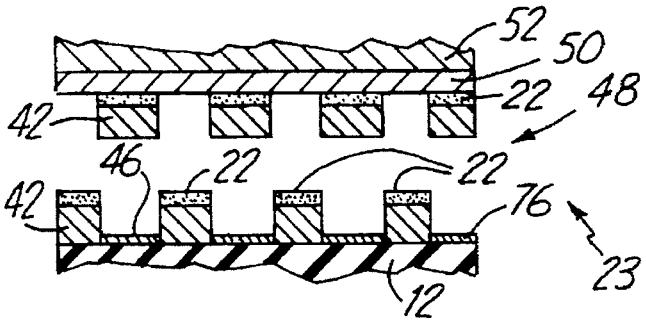
FIG. 7 is a cross sectional view of one embodiment of the tamper evident seal in a open position.

In this embodiment, when a peel force is applied to the sealing component 23, separation is made so that substantially transparent indicia are displayed on the sealing component 23, in a pattern defined by the release coating 46 as is shown in FIG. 7. Indicia having the color of the first coating 42 are displayed on the label component 45 on the canister 26.

One other embodiment of the tamper evident seal system 40 includes a fused adhesive layer. The fused adhesive layer is formed when a second adhesive layer is applied over the background layer 44. The second adhesive layer contacts and is compatible with the first adhesive layer 22 and forms the strong fused adhesive layer. The fused adhesive layer forms a strong bond with the background ink layer 44. In this system embodiment, when a peel force is applied to the sealing component 23, the fused adhesive layer pulls the background ink layer away from the canister to reveal the pattern of indicia formed by the release coating 46 on the canister 26.

In one embodiment, the tamper evident seal 40 is formed by applying the PVC layer 12 to the overcap 24 resting on the canister 26 so that the polyvinyl chloride band 12 of the seal 40 is in contact with the overcap 24. A remaining portion of the seal 40 is positioned proximal to the canister 26.

Figure 4:
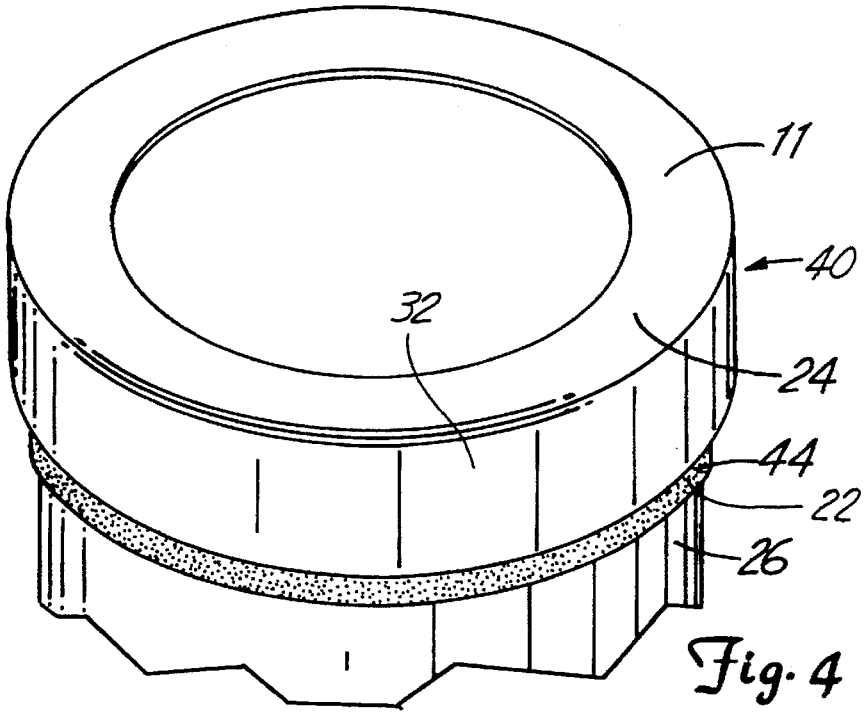
FIG. 4 is a perspective view of one other embodiment of the tamper evident seal of the present invention.

The adhesive layer 22 of the tamper evident seal 40 contacts the background ink layer 44 of the canister 26. The adhesive layer 22 secures the tamper evident shrink band 40 to the canister 26 as shown in FIG. 4. Once the PVC shrinkable band 12 has been heat shrunk around the overcap 24 and the adhesive heated to bond with the background ink 44, the package of overcap 24 and canister 26 is sealed.

To open the canister 26 by removing the overcap 24, a user must breach the tamper evident seal 40 or 41. Similarly to previous embodiments, the system 40 or 41 may include the tab 32 that a user may pull in order to breach the system 40. The user may then circumferentially pull the sealing component 23 away from the canister 26.

To provide the most distinctive signal that tampering has occurred, it is desirable to color coordinate each of the background ink layer 44, the indicia 46 and the copy ink layer 50. In particular, it is desirable for some embodiments that the indicia be contrasted with the copy ink layer 50 using colors such as red for the copy ink layer 50 and silver for the indicia. It is also desired that the background ink layer 44 mask the indicia 46 and copy ink layer 50 so that when the canister 26 is sealed, only the first coating 42 is visible.

The tamper evident seal 10 and system 40 are manufactured by steps that include shrinking the PVC band 12 in a cross machine direction, layering the PVC band 12 with ink colorant first, then adhesive by a conventional roto gravure method. The next steps include applying the layered band to the overcap 24 and canister 26 and heating the band 12, overcap 24 and canister 26 to shrink the PVC band above the overcap 24 and to melt the adhesive. One other step includes treating the PVC band 12 to become receptive to bonding by inks. The inner surface of the PVC band 12 is treated by corona discharge, flame treatment, ozone treatment or other methods conventionally known.

It is preferred that the polyvinyl chloride material of the band 12 is shrunk on a conventional shrink sealer, operating at about 72 CPM. It is also preferred that the bond strength of the adhesive have a capacity to peel ink from the canister surface 28 when the adhesive is heated at 420° F. air temperature in a tunnel for 6 seconds.

When the tamper evident band 10 is formed, the band 10 is seamed into a tube shape using a solvent seal. Preferably, ends of the band are free of ink in order to form an overlap for the band. Suitable sealing solvents include tetrahydrofuran.

The tamper evident band is heat shrunk in a heat tunnel where it is conveyed by conveyor. The tunnel temperature must be set high enough to activate the adhesive and shrink the PVC band and low enough so perforations in the seal 10 will not melt excessively. The optimum tunnel temperature in one run was about 400° F. while the conveyor speed was about 0.44 feet per second.

Although the present invention has been described with reference to preferred embodiments, workers skilled in the art will recognize that changes may be made in form and detail without departing from the spirit and scope of the invention.

What is claimed is:

1. A tamper evident container sealing system for sealing a cap to a container comprising:

a shrink band shrinkable at a shrink temperature positioned about the cap and container outer surfaces circumferentially, and a colorant bonded to the shrink band said shrink band having a first non-adhesive section positioned about the cap and a second adhesive tamper evident section positioned about the container, the second section having a thermally activatable adhesive bonded thereto; wherein the adhesive is activated at the shrink temperature and is unactivated at a temperature lower than the shrink temperature, and wherein the adhesive, when activated, causes the second adhesive tamper evident section to form a chemical bond with the container and the first non-adhesive section to form a mechanical bond with the cap at substantially the same temperature to Secure the cap to the container.

2. The sealing system of claim 1 and further including a second colorant bonded to each of the first colorant and the adhesive.

3. The sealing system of claim 2 wherein the second colorant is a discrete layer forming indicia over the first colorant.

4. The sealing system of claim 1 wherein the shrink band shrinks in a cross machine direction less than about 50% when exposed to an effective heating temperature.

5. The sealing system of claim 2 wherein the adhesive is separable from the shrink band upon application of a peel force.

6. The sealing system of claim 3 wherein the indicia of the second colorant are exposed when a peel force is applied to the sealing system.

7. A tamper evident container sealing system for sealing a cap to a container comprising:

a shrink band, shrinkable at a shrink temperature, positioned circumferentially about the cap and container;

a first coating bonded to the shrink band;

a thermally activatable adhesive coating activatable at the shrink temperature, bonded to the first coating, the shrink band having a first non-adhesive section positioned about the cap and a second adhesive tamper evident section positioned about the container wherein the adhesive is activated at the shrink temperature such that the second adhesive tamper evident section forms a chemical bond with the container and the first non-adhesive section forms a mechanical bond with the cap at substantially the same temperature to secure the cap to the container;

a background ink coating bonded to the adhesive;

indicia defined by a release coating proximal to the background ink coating, the indicia being revealed to a user when the sealing system is breached; and a copy ink layer bonded to the indicia, the copy ink layer further bonded to the container.

8. The tamper evident container sealing system of claim 7 wherein the background ink coating and copy ink layer and first coating are added by printing.

9. A method for making a tamper evident seal on a container having an overcap comprising:

applying a heat shrinkable strip, shrinkable at a shrink temperature, to the overcap and container circumferentially, the heat shrinkable strip including a colorant and an adhesive bonded to the colorant, the adhesive activatable at the shrink temperature and contacting the container; and heating the overcap, container and heat shrinkable strip at a temperature effective to shrink the heat shrinkable strip and activate the adhesive thereby forming a mechanical bond with the overcap and a chemical bond with the container at substantially the same temperature to secure the overcap to the container.

* * * * *

UNITED STATES PATENT AND TRADEMARK OFFICE

CERTIFICATE OF CORRECTION

PATENT NO. : 5,641,084
DATED : June 24, 1997
INVENTOR(S) : Michael J. Rice

It is certified that error appears in the above-indentified patent and that said Letters Patent is hereby corrected as shown below:

Column 8, Line 22, delete "Secure" and replace with --secure--.

Signed and Sealed this

Tenth Day of February, 1998

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,641,084

DATED : June 24, 1997

INVENTOR(S) : Rice, Michael J.

It is certified that error appears in the above-indentified patent and that said Letters Patent is hereby corrected as shown below:

Column 6, Line 34, delete "silicon" and replace with --silicone--

Column 6, Line 34, delete "emulsifiers" and replace with --emulsions--

Signed and Sealed this

Twenty-sixth Day of January, 1999

*Attest:*

*Attesting Officer*

*Acting Commissioner of Patents and Trademarks*